US009321611B2

(12) United States Patent
Wei

(10) Patent No.: US 9,321,611 B2
(45) Date of Patent: Apr. 26, 2016

(54) ELEVATOR BRAKE HAVING A BRAKE RELEASE FEATURE

(75) Inventor: Wei Wei, Farmington, CT (US)

(73) Assignee: OTIS ELEVATOR COMPANY, Farmington, CT (US)

( * ) Notice: Subject to any disclaimer, the term of this patent is extended or adjusted under 35 U.S.C. 154(b) by 127 days.

(21) Appl. No.: 14/111,817

(22) PCT Filed: Apr. 19, 2011

(86) PCT No.: PCT/US2011/032983
§ 371 (c)(1),
(2), (4) Date: Oct. 15, 2013

(87) PCT Pub. No.: WO2012/144988
PCT Pub. Date: Oct. 26, 2012

(65) Prior Publication Data
US 2014/0041967 A1 Feb. 13, 2014

(51) Int. Cl.
*B66B 5/22* (2006.01)
*B66B 5/24* (2006.01)

(52) U.S. Cl.
CPC .... *B66B 5/22* (2013.01); *B66B 5/24* (2013.01)

(58) Field of Classification Search
CPC ..... B66B 5/22; B66B 5/24
USPC ..... 187/376
See application file for complete search history.

(56) References Cited

U.S. PATENT DOCUMENTS 3,014,865 A * 12/1961 Seniff et al. ..... 508/167
3,762,512 A * 10/1973 McIntyre ..... 188/189
5,301,773 A 4/1994 Jamieson et al.
5,363,942 A 11/1994 Osada
5,782,319 A 7/1998 Woodruff et al.
5,819,879 A 10/1998 Lang et al.
5,979,615 A 11/1999 Thompson et al.
6,823,969 B2 11/2004 Simmonds et al.
6,997,287 B2 2/2006 Sasaki
7,036,638 B2 5/2006 Simmonds et al.
7,080,717 B2 * 7/2006 Ito ..... 187/350

(Continued)

FOREIGN PATENT DOCUMENTS

CN 1217289 A 5/1999
CN 2711118 Y 7/2005

(Continued)

OTHER PUBLICATIONS

English Machine Translation of WO 9731852 Al.*

(Continued)

*Primary Examiner* — William E Dondero
*Assistant Examiner* — Diem Tran
(74) *Attorney, Agent, or Firm* — Carlson, Gaskey & Olds

(57) ABSTRACT

An exemplary braking device for an elevator car includes a first brake member configured to remain fixed relative to an elevator car for applying a braking force to a first side of an element such as a guide rail. A second brake member is moveable relative to the first brake member for applying a braking force to a second side of the element. A brake release member adjacent the first brake member is received against the first side of the element between the first brake member and the first side of the guide rail. The brake release member is moveable relative to the first brake member for selectively releasing the braking device from engagement with the element.

21 Claims, 4 Drawing Sheets

(56) References Cited

U.S. PATENT DOCUMENTS

| | | | | |
|---|---|---|---|---|
| 7,575,099 | B2 | 8/2009 | Oh et al. | |
| 7,650,969 | B2 | 1/2010 | Monzon et al. | |
| 2004/0149524 | A1* | 8/2004 | Mori et al. | 187/373 |
| 2008/0128218 | A1* | 6/2008 | Gremaud et al. | 187/250 |

FOREIGN PATENT DOCUMENTS

| | | | | | |
|---|---|---|---|---|---|
| DE | 29614516 | U1 | * | 1/1998 | B66B 5/22 |
| DE | 102006046954 | A1 | * | 4/2008 | B66B 5/22 |
| EP | 0968954 | A | * | 9/1997 | |
| EP | 1942071 | A2 | * | 7/2008 | B66B 5/22 |
| FR | 775107 | A | * | 12/1934 | |
| JP | 55-140057 | | | 3/1954 | |
| JP | H02144389 | A | | 6/1990 | |
| JP | H11217167 | A | | 8/1999 | |
| JP | 2008260595 | A | * | 10/2008 | |
| JP | 2010001101 | A | | 1/2010 | |
| KR | 1020060057572 | A | | 5/2006 | |
| WO | 9731852 | | | 9/1997 | |
| WO | WO 9731852 | A1 | * | 9/1997 | B66B 5/22 |
| WO | WO 2004050525 | A1 | * | 6/2004 | B66B 5/22 |
| WO | 2009078844 | A1 | | 6/2009 | |

OTHER PUBLICATIONS

Machine Translation of DE 29614516.*
Machine Translation of DE 10 2006 046 954.*
Extended European Search Report for Application No. EP 11 86 3759 dated Aug. 20, 2014.
International Preliminary Report on Patentability for International application No. PCT/US2011/032983 dated Oct. 31, 2013.
International Search Report and Written Opinion of the International Searching Authority for International application No. PCT/US2011/032983 dated Dec. 23, 2011.
State Intellectual Property Office of People's Republic China, First Search, Application No. 201180070246.0 dated Jan. 6, 2015.

* cited by examiner

ELEVATOR BRAKE HAVING A BRAKE RELEASE FEATURE

BACKGROUND

Elevator systems include a variety of control devices to maintain control over movement of the elevator car. A motor causes desired movement of the elevator car to carry passengers to their intended destinations. A brake associated with the motor prevents the elevator car from moving when it is stopped at a landing requested by a passenger, for example. The brake associated with the motor is used to limit the movement or speed of the elevator car under most conditions.

It is possible for an elevator car (or counterweight) to move at a speed that is above a desired speed. Elevator systems include auxiliary brakes that are sometimes referred to as safeties for stopping the elevator car if it is moving above the desired speed. Some safeties have a fixed wedge and a moveable wedge that engage opposite sides of a guide rail for stopping the elevator car. Sometimes the forces associated with engaging the guide rail and stopping the elevator car are so large that they exceed the torque of the motor, which makes it difficult to move the car once the safety is engaged. It is desirable to be able to use the motor to cause the elevator car to move upward for releasing the safeties from the guide rails. When the fixed wedge is tightly wedged against the rail under many conditions, the torque of the motor is insufficient to cause such movement of the elevator car. It is then necessary for a mechanic to manually release the safety before the elevator car can be returned to service.

SUMMARY

An exemplary braking device for an elevator car includes a first brake member configured to remain fixed relative to an elevator car for applying a braking force to a first side of a guide rail. A second brake member is moveable relative to the first brake member for applying a braking force to a second, opposite side of the guide rail. A brake release member adjacent the first brake member is received against the first side of the guide rail between the first brake member and the first side of the guide rail. The brake release member is moveable relative to the first brake member for selectively releasing the braking device from engagement with the guide rail.

Another exemplary elevator braking system includes a first brake member configured to remain fixed relative to an elevator car for applying a braking force to a first side of a guide rail. A second brake member engages a second, opposite side of said guide rail. A third brake member is moveable relative to the first brake member for engaging the first side of the guide rail. One of the first or third brake members includes a first arm and a second arm for limiting relative vertical movement between said first and third brake members in a first direction and in a second, opposite direction.

An exemplary method of operating a braking system for an elevator car includes situating a brake release member between a fixed wedge brake member and a guide rail. Wedging the guide rail between the fixed wedge brake member and a second brake member applies a braking force to opposite sides of the guide rail with the brake release member received against the guide rail. Urging the elevator car upward when the guide rail is wedged between the first and second brake members causes selective movement between the fixed wedge brake member and the brake release member to release the braking force.

The various features and advantages of this invention will become apparent to those skilled in the art from the following detailed description. The drawings that accompany the detailed description can be briefly described as follows.

DETAILED DESCRIPTION

Figure 1:
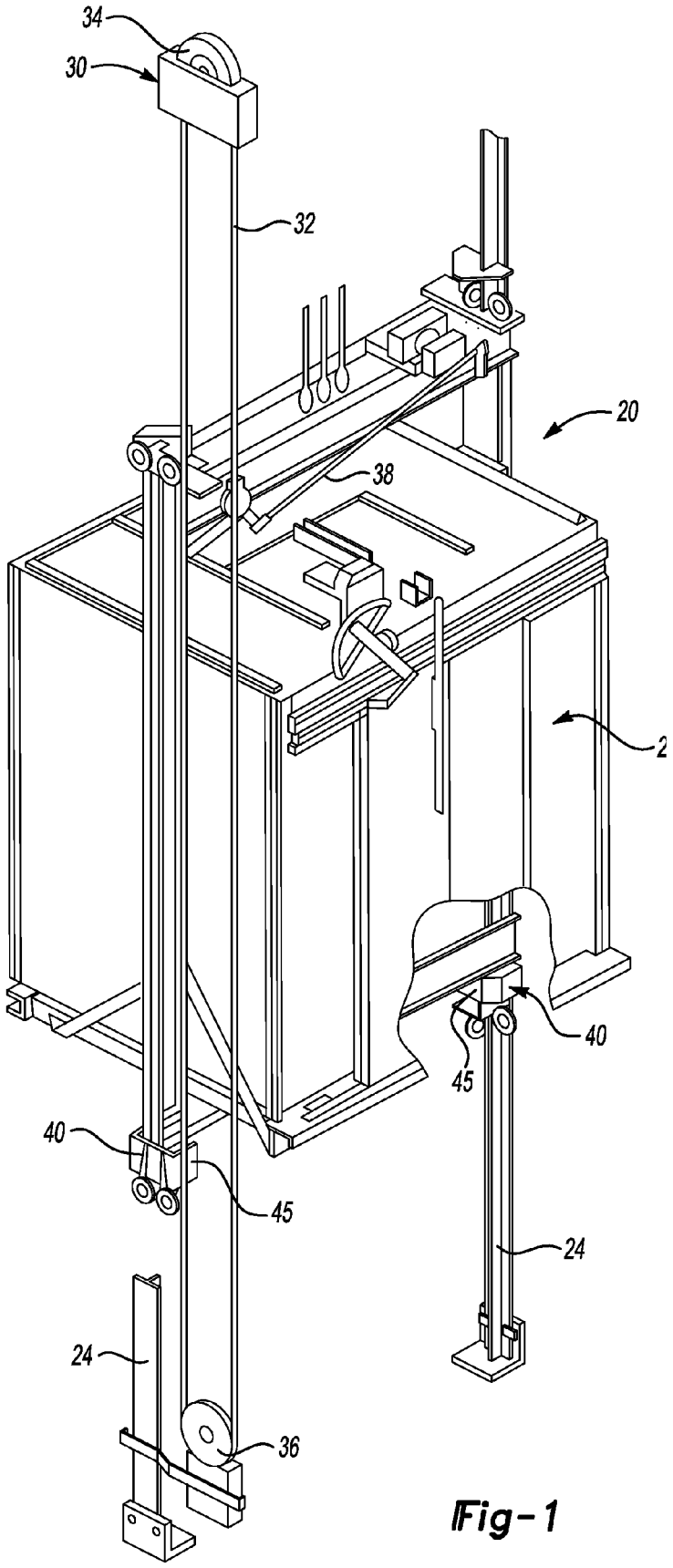
FIG. 1 schematically illustrates selected portions of an elevator system including a braking device designed according to an embodiment of this invention.

FIG. 1 schematically illustrates an example elevator system 20 including an elevator car 22 that moves along guide rails 24 in a known manner. A governor device 30 controls movement of the elevator car 22 by preventing the elevator car 22 from exceeding a selected maximum speed. The example governor device 30 includes a governor rope 32 that travels with the elevator car 22. A governor sheave 34 and a tension sheave 36 are located at opposite ends of a loop formed by the governor rope 32.

The illustrated governor device 30 operates in a known manner. In the event that the elevator car 22 moves to quickly, the governor device 30 exerts a braking force on the governor sheave 34, which causes the governor rope 32 to pull up on a mechanical linkage 38 to activate braking devices 40 supported on the elevator car 22. The braking devices 40 apply a braking force to an element to prevent further movement of the elevator car 22. In this example, the braking devices 40 apply the braking force to the guide rails 24.

Figure 2:
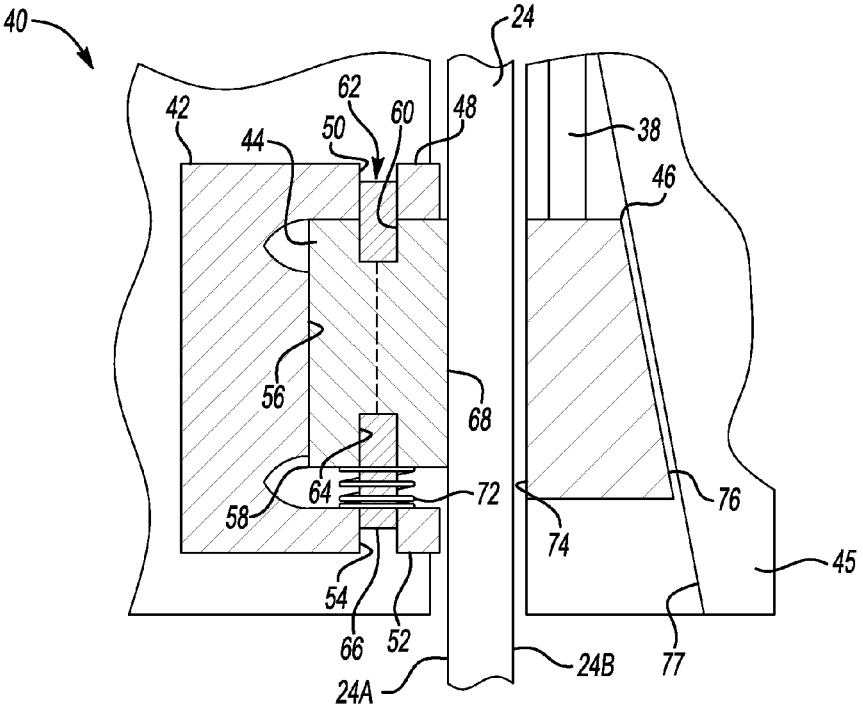
FIG. 2 schematically illustrates an example braking device.

FIG. 2 illustrates one example braking device 40 having a first brake member 42, a brake release member 44, and a second brake member 46. The braking device 40 has a housing 45 that is configured to be fixedly connected to the elevator car 22 (FIG. 1). The first brake member 42 in this example comprises a fixed wedge that remains in a fixed position relative to the housing 45 and the elevator car 22. The first brake member 42 applies a braking force to a first side 24A of the guide rail 24 when the governor device 30 causes actuation of the braking device 40.

The brake release member 44 is positioned adjacent the fixed wedge first brake member 42 between the first brake member 42 and the first side 24A of the guide rail 24. The brake release member 44 is moveable relative to the first brake member 42. The brake release member 44 engages the first side 24A of the guide rail 24 when the first brake member 42 applies the braking force.

Relative movement between the first brake member 42 and the brake release member 44 is limited by the structure of at least one of those components. In this example, the first brake member 42 includes a first arm 48 having a first guide pin aperture 50, a second arm 52 having a second guide pin aperture 54, and a sliding contact surface 56 for contacting a sliding contact surface 58 located on the brake release member 44. At least a portion of the brake release member 44 is received between the first arm 48 and the second arm 52 such that each arm establishes a limit or end of possible vertical movement of the brake release member 44 relative to the first brake member 42. In this example, the entire brake release member is effectively received between the arms 48 and 52.

The brake release member 44 remains in a set position relative to the first brake member 42 during movement of the elevator car 22. This position is shown in the illustration of FIG. 2. The brake release member 44 remains in the same set position during a braking application in which the first brake member 42 applies a braking force to the first side 24A of the guide rail 24. The illustrated example includes structure for reliably keeping the brake release member in the set position.

The illustrated brake release member 44 includes a first aperture 60 for accepting a portion of a first guide pin 62. Another portion of the guide pin 62 is received in the aperture 50 of the first arm 48 to allow the pin 62 to slide within the aperture 50. The brake release member 44 includes a second aperture 64 for accepting a portion of a second guide pin 66. Another portion of the second guide pin 66 is received in the aperture 54 to allow sliding movement of the pin 66 relative to the second arm 52. A biasing member 72, which comprises a spring in the illustrated example, biases the brake release member 44 toward the set position where an upper surface of the brake release member 44 engages the first arm 48.

In the illustrated example, the brake release member has a frictional surface 68 for engaging the guide rail 24 during a brake application.

The second brake member 46 comprises a sliding wedge in the illustrated example. The second brake member 46 is configured to be moveable relative to the brake housing 45 for engaging a second guide rail surface 24B. The second brake member 46 includes a frictional surface 74 for engaging the second guide rail surface 24A and an angled surface 76 that follows a guide slot 77 in the housing 45 for directing the second brake member 46 toward the guide rail 24 when actuated by the linkage 38. For example, when the governor device 30 detects an over speed condition, it causes the linkage 38 to pull the sliding wedge second brake member 46 upward (according to the drawing). Such movement of the second brake member 46 causes it and the first brake member 42 to apply braking forces to the oppositely facing guide rail surfaces 24B and 24A, respectively.

Figure 3:
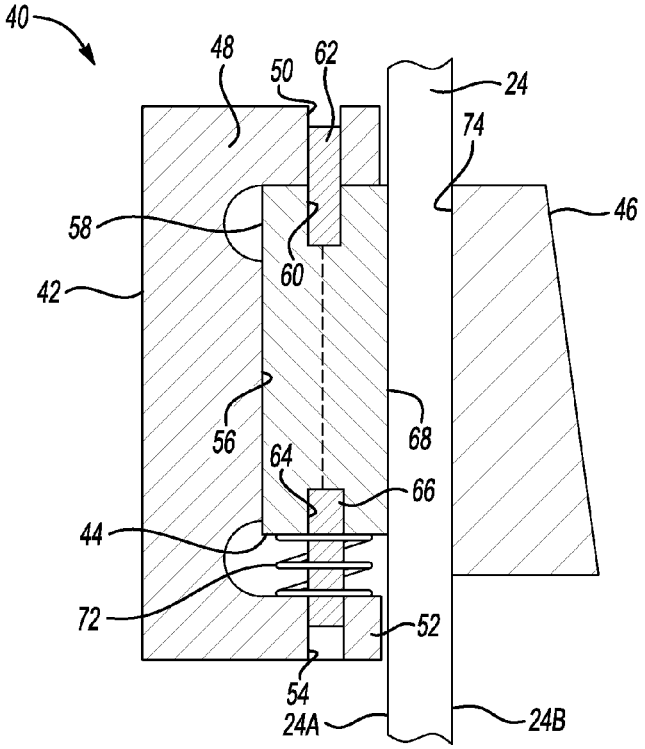
FIG. 3 illustrates the embodiment of FIG. 2 in another operating condition.

FIG. 3 illustrates the example braking device 40 in an actuated condition in which a braking force is applied to the guide rail 24 to stop the elevator car 22. As can be appreciated from the drawing, the brake release member 44 is in the set position and the frictional surfaces 68 and 74 engage the guide rail 24 when the brake is applied. In this condition, the brake release member 44 engages the guide rail surface 24A but the fixed wedge first brake member 42 does not. Having the brake release member securely maintained in the set position allows the braking force applied by the first brake member 42 to be effectively transferred through the brake release member 44 to the surface 24A. In this condition, the brake release member is acting as if it is part of the first brake member 42 for purposes of applying the necessary braking force provided by the fixed wedge first brake member 42.

According to the drawing, the braking device 40 is moving downward as the elevator car 22 descends along the guide rails 24. Such downward movement does not change the position of the brake release member 44 relative to the first brake member 42 during brake application (e.g., the forces associated with brake application tend to urge the brake release member 44 against the arm 48 into the set position). Once the situation requiring engagement of the braking device 40 has been addressed or resolved, it is necessary to release the braking device 40 to allow the elevator 22 to return to serving passengers. The brake release member 44 facilitates releasing the braking device 40.

Figure 4:
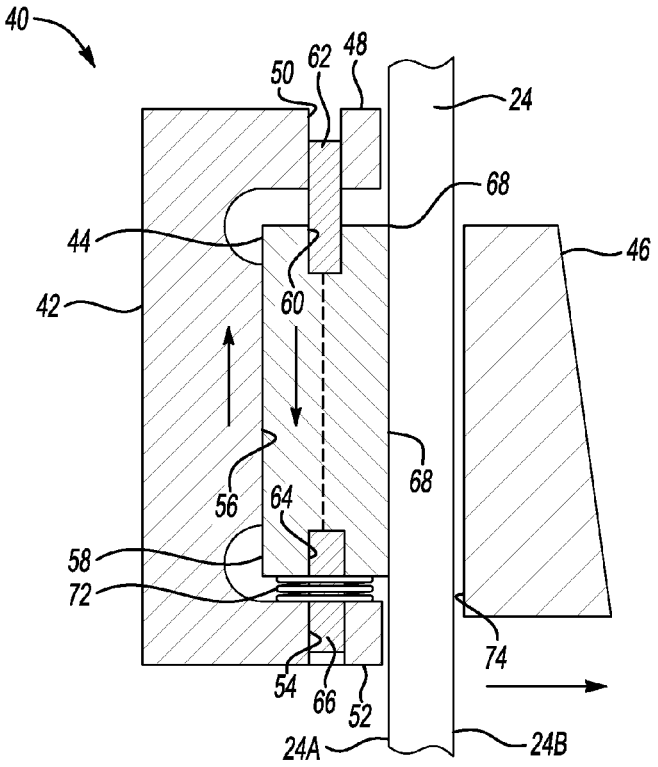
FIG. 4 illustrates the embodiment of FIG. 2 in another operating condition.

FIG. 4 illustrates the braking device 40 moving toward a disengaged position resulting from upward movement of the elevator car 22 as caused by the elevator motor (not illustrated). As the first brake member 42 is urged in a vertical direction, the brake release member 44 slides relative to the first brake member 42. The brake release member is wedged against the surface 24A but the sliding contact surfaces 56 and 58 allow relative movement between the members 42 and 44. A lubricant, such as a molybdenum disulfide or another dry lubricant is located on the sliding contact surfaces 56 and 58 in some examples to decrease the coefficient of friction between those surfaces so that the frictional forces between the sliding contact surfaces 56 and 58 are less than the frictional forces between the frictional surface 68 and the guide rail surface 24A. Those lower frictional forces between the sliding contact surfaces 56 and 58 permits relative movement between the first brake member 42 and the brake release member 44 while the brake release member 44 remains engaged with the guide rail 24. As the first brake member 42 moves upward even slightly, the braking device 40 releases because the corresponding relative movement between the housing 45 and the sliding wedge second braking member 46 allows the latter to be separated from the guide rail surface 24B. The lower frictional forces between the sliding surfaces 56 and 58 allow for the elevator system motor torque to be sufficient to disengage the brake.

The spring 72 is eventually fully compressed between the second arm 52 and a lower surface on the brake release member 44 as the elevator car 22, the housing 45 and the first brake member 42 continue to move upward while the brake release member 44 remains in contact with the guide rail surface 24A. The second arm 52 provides a stop surface to limit the relative movement of the brake release member 44 during brake release.

After the braking device 40 is disengaged and the elevator car is moveable again, the biasing member 72 urges the brake release member 44 back into the set position (e.g., the position shown in FIG. 2) where it remains until the next brake application and release sequence.

Figure 5:
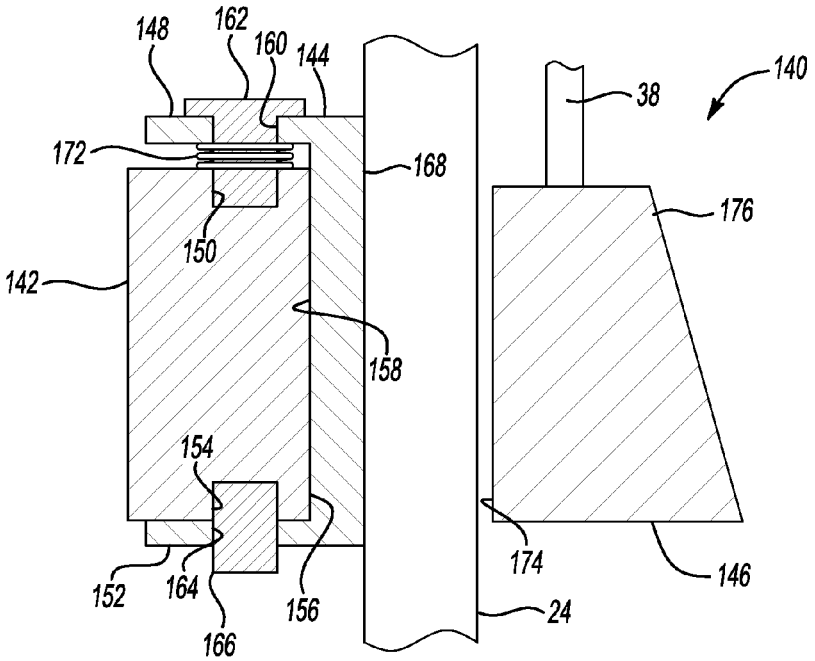
FIG. 5 schematically illustrates another example braking device.
Figure 6:
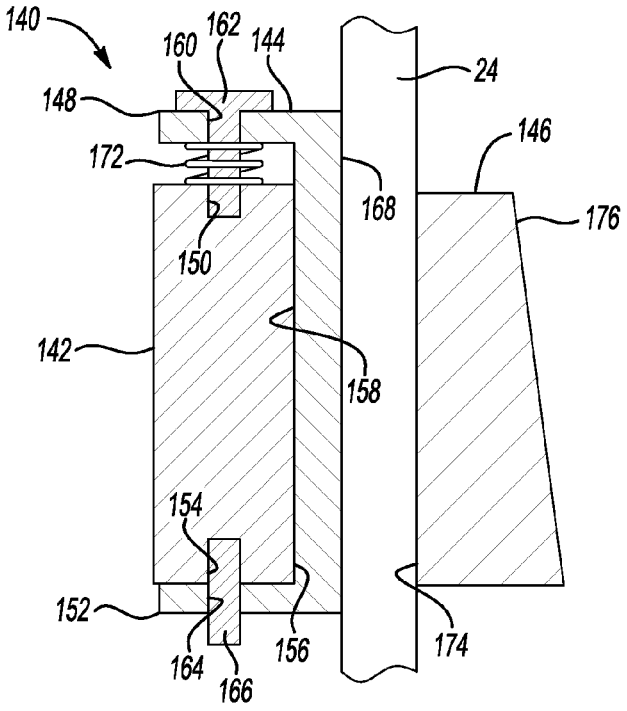
FIG. 6 illustrates the embodiment of FIG. 5 in another operating condition.
Figure 7:
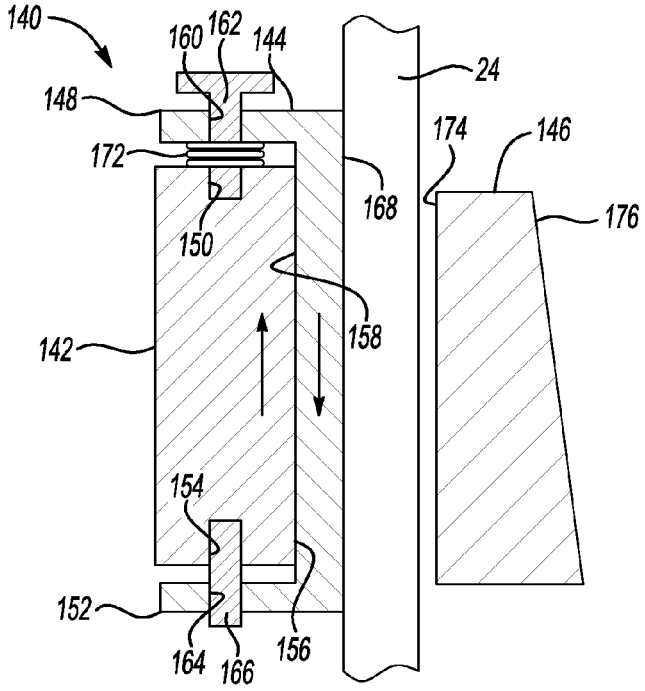
FIG. 7 illustrates the embodiment of FIG. 5 in another operating condition.

FIGS. 5-7 illustrate another example braking device 140. In this example, the brake release member 144 includes arms 148 and 152. A portion of the first brake member 142 is received between the arms 148 and 152 such that the arms limit relative vertical movement (according to the drawing) between the members 142 and 144.

In this example the arm 148 includes an aperture 160 that receives a portion of a first guide pin 162. Another portion of the guide pin 162 is received in a first guide pin aperture 150 on the first brake member 142. The arm 152 includes an aperture 164 that receives a portion of a second guide pin 166. Another portion of that pin 166 is received in a second guide pin aperture 154 on the first brake member 142. The guide pins maintain a desired orientation between the first brake member 142 and the brake release member 144 while allowing relative movement between them. A sliding contact surface 156 on the first brake member 142 is received against a sliding contact surface 158 located on the brake release member 144.

A frictional surface 168 is located on an opposite side of the brake release member 144 from the sliding contact surface 158 for engaging the guide rail 24. The brake release member 144 is located between the first brake member 142 and the guide rail 24. A biasing member 172, such as a spring in the illustrated example, biases the brake release member 144 towards the set position where a lower surface of the first brake member 142 engages the second arm 152.

The second brake member 146, which comprises a sliding wedge in the illustrated example, is located on an opposite side of the guide rail 24 from the first brake member 142. The second brake member 146 includes a frictional surface 174 for engaging the guide rail 24 and an angled surface 176 that follows a guiding groove on the associated housing for directing the second brake member 146 into engagement with the guide rail 24 when actuated by the mechanical linkage 38. As in the previous example, as the second brake member 146 is pulled into engagement with the guide rail 24, that causes the first brake member to apply a braking force to the guide rail 24 through the brake release member 144.

FIG. 6 illustrates the braking device 140 with the first brake member 142 in the set position and the frictional surfaces 168 and 174 fully engaging the guide rail 24. The fixed wedge first brake member 142 is moving downward during descent of the elevator car so that when the braking force is applied, the brake release member remains in the set position. In other words, during a brake application, the brake release member 144 would tend to be urged upward but the arm 152 engaging the corresponding portion of the first brake member 142 prevents the brake release member from moving out of the set position.

Once the situation requiring the brake application has been resolved, it is time to release the brake to allow the elevator car 22 to return to service. The brake release member 144 facilitates brake release in a similar fashion to that described above regarding operation of the brake release member 44. FIG. 7 illustrates the braking device 140 moving towards a disengaged position. As the first brake member 142 is urged in a vertical direction with upward movement of the elevator car, the brake release member 144 remains fixed relative to the guide rail. This results in relative movement between the first brake member 142 and the brake release member 144.

In this example, the members 142 and 144 slide relative to each other as facilitated by sliding contact surfaces 156 and 158. A lubricant, such as a molybdenum disulfide or another dry lubricant is located on the sliding contact surfaces 156 and 158 in some examples to decrease the coefficient of friction between the surfaces 156 and 158. The frictional forces between the sliding contact surfaces 156 and 158 is less than the frictional forces between the frictional surface 168 and the guide rail 24. The lower frictional forces between the first and second sliding surfaces 156 and 158 allows for relative movement between the first brake member 142 and the brake release member 144, which allows the first brake member 142 and the associated brake housing to move relative to the guide rail 24.

Even slight upward movement of the elevator car is sufficient to release the braking device from engagement with the guide rail. The lower frictional forces between the sliding surfaces 156 and 158 allow for the elevator system motor torque to be sufficient to disengage the brake.

As the first brake member 142 continues to move upward, an upper surface of the first brake member 142 may engage the first arm 148 on the brake release member 144. Such contact limits the relative movement between the members 142 and 144. That contact also facilitates moving the brake release member 144 relative to the guide rail 24. During subsequent movement of the elevator car, the biasing member 172 (e.g., a spring) urges the brake release member 144 back into the set position.

The disclosed examples provide a robust way of facilitating reliable release of elevator safeties. The brake release members in the illustrated examples do not interfere with the ability for a fixed wedge brake member to apply a brake force to a guide rail. The example brake release members provide an ability to achieve relative movement between the brake members and the guide rail for releasing the brake by controlling the motor responsible for moving the elevator car.

In some examples, the braking device acts on a guide rail as discussed above. In other examples, the braking device acts on a rope.

Although a preferred embodiment of this invention has been disclosed, a worker of ordinary skill in this art would recognize that certain modifications would come within the scope of this invention. For that reason, the following claims should be studied to determine the true scope of legal protection granted to this invention.

What is claimed is:

1. An elevator braking device, comprising:

a first brake member for applying a braking force to a first side of an element;

a second brake member that is moveable relative to the first brake member for applying a braking force to a second side of the element;

a brake release member adjacent the first brake member to be received against the first side of the element between the first brake member and the first side of the element, the brake release member being moveable relative to the first brake member for selectively releasing the elevator braking device from engagement with the element; and at least one guide pin, wherein said brake release member is selectively movable relative to said first brake member on the at least one guide pin;

said first brake member includes a first arm and a second arm;

the brake release member is received between said first arm and said second arm;

a top of the brake release member being beneath an upper one of said first arm and said second arm;

a bottom of the brake release being above a lower one of said first arm and said second arm;

one of said first arm and said second arm limits movement of said brake release member in a first direction beyond a selected position that corresponds to a position of the brake release member when the braking force is applied to the first side of the element; and the other of said first arm and said second arm limits movement of said brake release member in a second, opposite direction.

2. The device of claim 1, wherein the first brake member is configured to remain fixed relative to an elevator car;

the brake release member remains in a set position relative to the first brake member during movement of said elevator car;

the brake release member remains in the set position when said first brake member applies the braking force to the first side of the element; and said brake release member is moveable relative to said first brake member and out of the set position to allow selected movement of said first brake member relative to the element for releasing the braking force applied to the first side of the element.

3. The device of claim 2, wherein the selected movement of said first brake member is in a vertical direction.

4. The device of claim 2, comprising a biasing member between said first brake member and said brake release member, the biasing member biasing said brake release member towards the set position.

5. The device of claim 1, wherein said first brake member is a fixed wedge and said second brake member is a sliding wedge.

6. The device of claim 1, including a lubricant between said first brake member and said brake release member.

7. The device of claim 6, wherein said lubricant is molybdenum disulfide.

8. An elevator braking device, comprising:

a first brake member for applying a braking force to a first side of an element;

a second brake member that is moveable relative to the first brake member for applying a braking force to a second side of the element;

a brake release member adjacent the first brake member to be received against the first side of the element between the first brake member and the first side of the element, the brake release member being moveable relative to the first brake member for selectively releasing the elevator braking device from engagement with the element; and at least one guide pin, wherein said brake release member is selectively movable relative to said first brake member on the at least one guide pin;

said brake release member includes first and second arms;

said first brake member is received between said first and second arms with a top of said first brake member beneath an upper one of said first and second arms and a bottom of said first brake member above a lower one of said first and second arms;

one of said first and second arms limits movement of said brake release member in a first direction beyond a selected position that corresponds to a position of the first brake member relative to the brake release member when the braking force is applied to the first side of the element; and the other of said first and second arms limits movement of said brake release member in a second, opposite direction.

9. The device of claim 8, wherein a frictional force between said first brake member and said brake release member is less than a frictional force between said brake release member and the element when said brake release member engages the element.

10. The device of claim 8, comprising a brake housing and wherein the first brake member remains fixed relative to the brake housing;

the second brake member moves within a guide slot in the brake housing; and the brake release member is moveable relative to the brake housing.

11. The device of claim 8, wherein the first brake member is configured to remain fixed relative to an elevator car;

the brake release member remains in a set position relative to the first brake member during movement of said elevator car;

the brake release member remains in the set position when said first brake member applies the braking force to the first side of the element; and said brake release member is moveable relative to said first brake member and out of the set position to allow selected movement of said first brake member relative to the element for releasing the braking force applied to the first side of the element.

12. The device of claim 8, including a lubricant between said first brake member and said brake release member.

13. The device of claim 12, wherein said lubricant is molybdenum disulfide.

14. An elevator braking system, comprising:

a first brake member configured to remain fixed relative to an elevator car for applying a braking force to a first side of an element;

a second brake member for engaging a second side of said element;

a third brake member moveable relative to said first brake member for engaging the first side of the element, wherein one of said first brake member and said third brake member includes a first upper arm and a second lower arm for limiting relative vertical movement between said first brake member and said third brake member in a first direction and in a second opposite direction, and wherein the other of said first brake member and said third brake member has a top received beneath said first upper arm and a bottom received above said second lower arm; and at least one guide pin, wherein said third brake member is selectively movable relative to said first brake member on the at least one guide pin.

15. The system of claim 14, wherein said third brake member remains in a set position during movement of the elevator car;

the third brake member remains in the set position corresponding when the first brake member applies the braking force to the first side of said element; and said third brake member is moveable relative to said first brake member to allow selected movement of said first brake member relative to said element for releasing the braking force applied to the first side of the element.

16. The system of claim 15, wherein said first arm and said second arm are located on said first brake member.

17. The system of claim 15, wherein said first arm and said second arm are located on said third brake member.

18. The system of claim 14, wherein the third brake member comprises a brake release member that is received between the first brake member and the first side of the element when the first brake member applies the braking force to the first side of the element.

19. The system of claim 14, wherein the third brake member comprises a generally planar plate having one side configured to engage the first side of the element and a second side received against the first brake member.

20. The system of claim 14, comprising a lubricant including molybdenum disulfide between said first brake member and said third brake member.

21. The system of claim 14, wherein said first brake member is a fixed wedge and said second brake member is a sliding wedge.

* * * * *

UNITED STATES PATENT AND TRADEMARK OFFICE

CERTIFICATE OF CORRECTION

PATENT NO. : 9,321,611 B2
APPLICATION NO. : 14/111817
DATED : April 26, 2016
INVENTOR(S) : Wei Wei It is certified that error appears in the above-identified patent and that said Letters Patent is hereby corrected as shown below:

IN THE CLAIMS:

Claim 1, column 6, line 38; after "release" insert --member--

Signed and Sealed this
Nineteenth Day of July, 2016

Michelle K. Lee

Michelle K. Lee
*Director of the United States Patent and Trademark Office*